United States Patent [19]

O'Neal

[11] 4,114,778

[45] Sep. 19, 1978

[54] SANITARY DRINKING SPOUT FOR LIQUID CONTAINER WITH TEAR TAB

[76] Inventor: Chester L. O'Neal, 101 S. Locust, Greencastle, Ind. 46135

[21] Appl. No.: 757,354

[22] Filed: Jan. 6, 1977

Related U.S. Application Data

[63] Continuation-in-part of Ser. No. 616,568, Sep. 25, 1975, abandoned, which is a continuation-in-part of Ser. No. 513,762, Oct. 10, 1974, Pat. No. 3,951,316.

[51] Int. Cl.[2] ..... B65D 41/32

[52] U.S. Cl. ..... 220/267; 220/269; 220/271

[58] Field of Search ..... 220/267, 269, 270, 271, 220/277

[56] References Cited

U.S. PATENT DOCUMENTS

| | | | |
|---|---|---|---|
| 3,730,380 | 5/1973 | Silver | 220/269 |
| 3,910,454 | 10/1975 | Novak | 220/269 |

*Primary Examiner*—George T. Hall

*Attorney, Agent, or Firm*—Woodard, Weikart, Emhardt & Naughton

[57] ABSTRACT

A sanitary drinking spout interiorly attached to a liquid container and extendable therefrom. The container includes a top wall with an aperture sealed by a tear tab. The spout includes a pair of flanges integrally attached together and spaced apart by a flexible center portion. The flanges are interiorly mounted to the top wall on opposite sides of the sealed aperture. The center portion of the spout is projectable when the aperture is opened by tearing the tab sealing the aperture closed. In one embodiment, a finger is mounted interiorly to the tear tab with the spout projecting between the finger and tear tab. Upon removal of the tear tab from the can, the finger forces the spout outwardly through the aperture. In another embodiment, a second aperture is provided on the top wall of the can for allowing air to enter the can facilitating pouring through the spout. In the preferred embodiment, the tear tab is not removed from the top wall but is torn partially from the top wall and bent over adjacent the rim of the container and then against the vertical side wall of the container. The preferred embodiment includes a T-shaped pull attached to the tear tab.

7 Claims, 16 Drawing Figures

SANITARY DRINKING SPOUT FOR LIQUID CONTAINER WITH TEAR TAB

CROSS REFERENCE TO RELATED APPLICATIONS

This application is a continuation-in-part application of my co-pending application, Ser. No. 616,568, filed Sept. 25, 1975 which is a continuation-in-part application of my prior application, Ser. No. 513,762, filed Oct. 10, 1974 and now U.S. Pat. No. 3,951,316.

FIELD OF THE INVENTION

This invention is in the field of containers with spouts.

DESCRIPTION OF THE PRIOR ART

A number of containers have been provided with pouring spouts such as those disclosed in the following U.S. patents:

U.S. Pat. No. 3,169,678 issued to H. E. Wilkinson;

U.S. Pat. No. 3,616,961 issued to S. C. Mallorca; and

U.S. Pat. No. 3,628,695 issued to C. F. Bryant.

Additional prior art has been cited by the U.S. Patent Office in my co-pending application and my U.S. Pat. No. 3,951,316, previously described herein. Liquids such as soft drinks are provided in metal containers having pull tab type tear strips. Such a tear strip is shown in the U.S. Pat. No. 3,473,705 issued to May which also discloses a spout extendable from the can. A similar variation is shown in the U.S. Pat. No. 3,481,515 issued to Booth.

Many of the prior art spouts have been designed with the primary purpose of providing a pouring spout as compared to the sanitary drinking spout disclosed herein. My spout is mounted to the interior surface of the can and is not directly connected to the tear tab as in some of the prior art devices. Thus, by not connecting the spout directly to the tear tab, the possibility of tearing of the spout is eliminated and as a result, the spout may be produced from a wax-covered paper. In addition, the spout is not connected to the can by a friction-type connection such as a hinge and instead is mounted directly to the can having a flexible portion resulting in lower costs and more reliable operations. The spout is adaptable to containers having tear drop-shaped tear tabs or circular pivoting closures.

In one embodiment of the container, the ring tab is integrally connected to the top wall of the container and is bent over and adjacent the rim of the container. As a result, the ring tab is not separated from the container providing a more acceptable container for ecological reasons.

Conventional ring pulls are relatively expensive to produce considering that the circular ring portion is produced via a metal curling operation. In addition, the rivet used to attach the ring to the tear tab involves a costly manufacturing step. Disclosed herein is a T-shaped pull which is relatively inexpensive to produce compared to the ring pull.

SUMMARY OF THE INVENTION

One embodiment of the present invention is a liquid containing metal can with sanitary drinking spout comprising a main body including a top wall, a bottom wall and a circular side wall sealingly joined to the top wall along a rim and joined to the bottom wall, the top wall having an aperture sealingly closed by a tear tab, the tear tab having an undersurface and a pair of opposite edges joined to the top wall along a pair of score lines, the tab having a first end positioned in the center of the top wall with a pull tab attached thereto and with the score lines meeting at the first end adjacent the pull tab, the tear tab having a second end opposite the first end with the second end positioned adjacent the rim, and the score lines terminate adjacent the second end, the second end being integral with the top wall and being bendable to allow the tear tab to be torn along the score lines and bent at the second end over the rim and externally against the side wall, and a sanitary drinking spout including a pair of flanges and a flexible center portion integrally attached to and disposed between the flanges, the flanges being fixedly attached to the top wall on opposite sides of the aperture within the main body, the center portion being projectable through the aperture when the tear tab is moved to open the aperture forming the spout extending away from the top wall and adjacent the second end and the undersurface of the tear tab which extends over the rim and against the side wall when opened, means operable to project the tear tab through the aperture as the tear tab is pivoted about the second end.

Another embodiment of the present invention is a container comprising a main body including a rim and a top wall with an aperture in the top wall sealingly closed by a tear tab, the tear tab having a pair of opposite edges joined to the top wall along a pair of score lines, the tear tab further having a first end with a pull tab attached thereto and with the score lines meeting at the first end adjacent the pull tab, the tear tab having a second end opposite the first end with the second end positioned adjacent the rim, and pierce means beneath the pull tab being operable when depressed to pierce the top wall and initiate tearing along the score lines.

It is an object of the present invention to provide a new and improved sanitary drinking spout for a liquid containing metal can.

A further object of the present invention is to provide a new and improved container with spout.

In addition, it is an object of the present invention to provide a spout mounted to a container having a flexible portion projectable through an aperture in the container.

Likewise, it is an object of the present invention to provide a spout mounted to a container having a flexible portion projectable through an aperture in the container with a tear tab normally concealing the spout and being movable to allow for the automatic erection of the spout while the tear tab is attached to the container at all times.

A further object of the present invention is to provide a new type of pull tab for opening the tear tab on a container.

Related objects and advantages of the present invention will be apparent from the following description.

DESCRIPTION OF THE PREFERRED EMBODIMENTS

Figure 1:
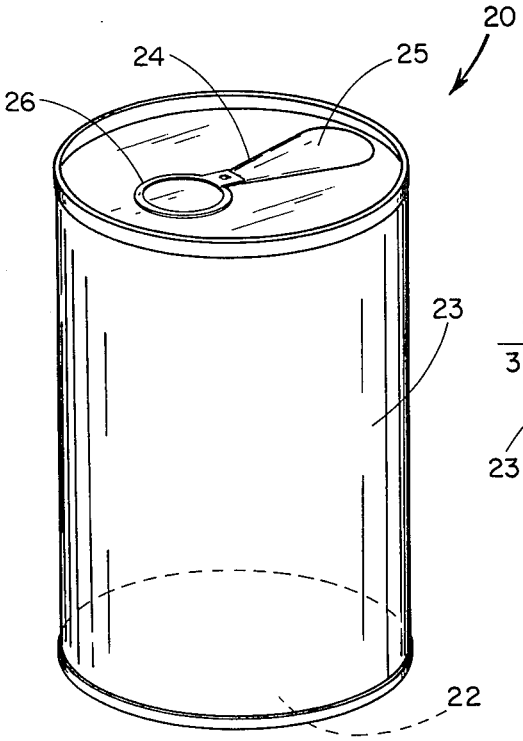
FIG. 1 is a perspective view of a container incorporating the present invention.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 2:
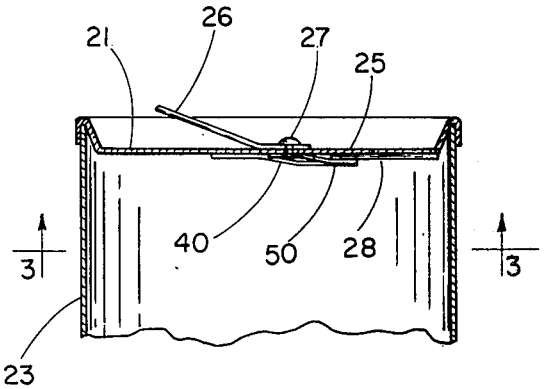
FIG. 2 is an enlarged cross-sectional view of the top portion of the container of FIG. 1.

Referring now more particularly to FIGS. 1 and 2, there is shown a liquid containing metal can 20 including a main body with a top wall 21, a bottom wall 22, and a circular side wall 23. The top and bottom wall are sealingly joined to the side wall forming a sealed enclosure.

Top wall 21 is provided with an aperture 24 sealingly closed by a conventional removable tear strip 25. Both the aperture and tear strip are tear drop shaped. A ring tab 26 is attached by fastener 27 to one end of tab 25 thereby allowing the consumer to pull the ring and remove the tear strip from the top wall of the can for the pouring of the liquid therefrom.

Figure 3:
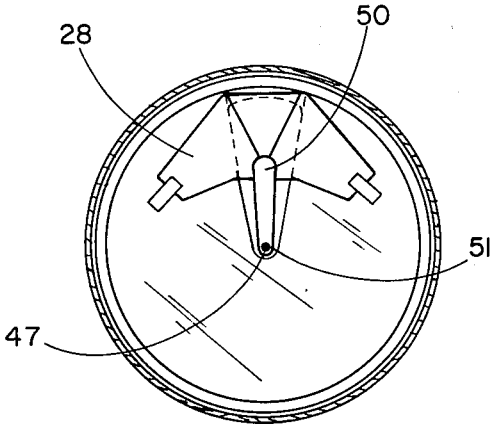
FIG. 3 is a cross-sectional view taken along the line 3—3 of FIG. 2 and viewed in the direction of the arrows.
Figure 5:
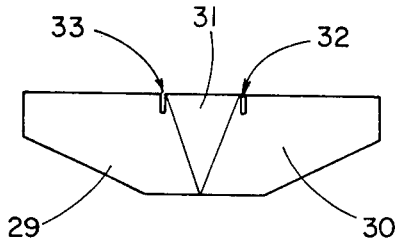
FIG. 5 is a plan view of the spout shown prior to mounting to the top wall of the container of FIG. 4.
Figure 6:
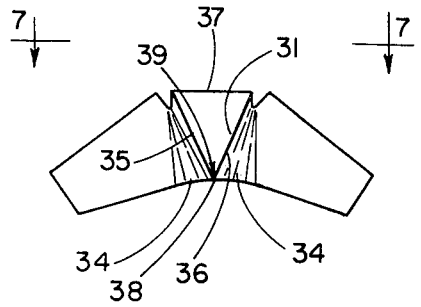
FIG. 6 is an enlarged view of the spout shown in FIG. 5 prior to mounting to the container.

A sanitary drinking spout 28 is mounted to the interior surface of top wall 21 and is projectable through aperture 24 once the tear tab is removed from the can. The spout 28 is shown in FIG. 5 prior to the mounting of the spout to the can. The spout includes a pair of flanges 29 and 30 integrally joined together and spaced apart by a flexible center portion 31. A pair of notches 32 and 33 are provided separating the flanges 29 and 30 from the center portion and allowing the flanges to be bent along a plurality of crease lines 34 (FIG. 6) to provide a more compact pouring spout for mounting to the top wall of the can as shown in FIGS. 2 and 3. The crease lines 34 extend across the flanges from each notch. The notches and crease lines allow the center portion to be movable with respect to the flanges. The center portion 31 has a flat triangular center formed by fold lines 35, 36 and edge 37. The fold lines 35 and 36 converge from edge 37 toward edge 38 to vertex 39. As a result, the center portion may be projectable through aperture 24 when the tab is moved to open the aperture.

Figure 4:
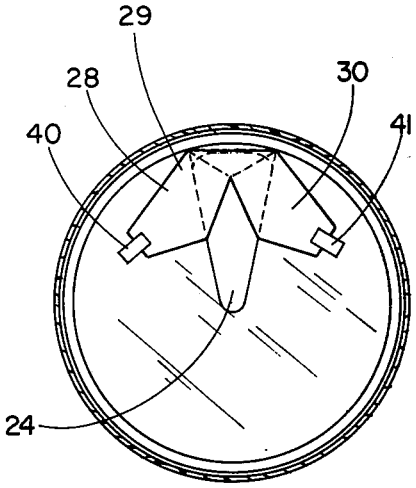
FIG. 4 is the same view as FIG. 3 only with the tear tab removed and the spout projecting through the top wall of the container.
Figure 7:
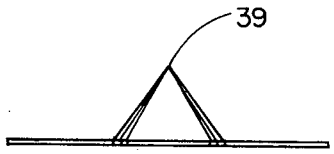
FIG. 7 is an end view of the spout looking in the direction of arrows 7—7 of FIG. 6.

Flanges 29 and 30 are fixedly attached to the interior surface of top wall 21 on opposite sides of aperture 24. The flanges may be secured to the top wall of the can by means such as adhesives. In addition, a pair of retainers 40 and 41 (FIG. 4) may be fixedly mounted to the interior surface of top wall 21 with the retainers engaging the flanges forcing the flanges against the top wall. The center portion of the spout is shown in the extended position in FIG. 7. Likewise, the spout is shown extending through aperture 24 in FIG. 4.

In the embodiment shown in FIGS. 1 through 4, a finger 50 having a cone-shaped configuration has one end 51 fixedly attached to fastener 47. The finger is cantileveredly mounted with spout 28 extending between finger 50 and tab 25. Thus, by pulling ring 26 and removing the tear tab 25 from the can, finger 50 forces the center portion of the pouring spout 28 to extend through aperture 24.

Figure 8:
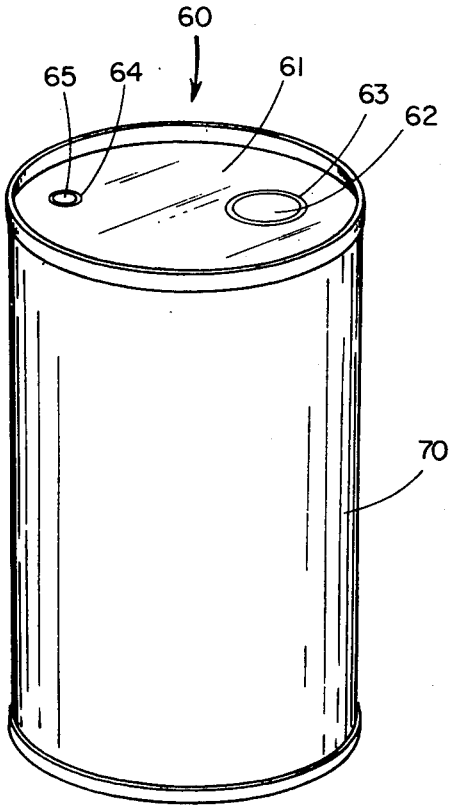
FIG. 8 is a perspective view of an alternate container using the present invention.
Figure 9:
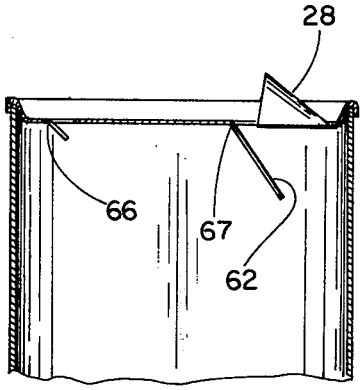
FIG. 9 is an enlarged cross-sectional view of the top portion of the container of FIG. 8.

Another embodiment of a liquid containing can is shown in FIGS. 8 and 9. Can 60 includes a top wall 61 having a large aperture 63 and a smaller aperture 64. Both apertures are sealingly closed by a pair of covers 62 and 65 pivotally mounted respectively at ends 67 and 66 and to the top wall. Cover 65 is punched inwardly providing an air hole in the top wall whereas cover 62 is punched inwardly allowing the liquid therein to be poured from the can. In the embodiment of the can 60 presently on the market, cover 62 is pivotally mounted to the top wall adjacent to the side wall 70 of the can in lieu of between apertures 63 and 64 as shown in FIG. 9. Cover 62 is pivotally mounted at end 67 between the two apertures in order to facilitate the mounting of the pouring spout 28 which is identical to the spout previously described.

It will be obvious from the above description that the present invention provides a new and improved sanitary drinking spout for a liquid contained can. The spout may be produced from wax paper or plastic and may be glued to the bottom surface of the top wall or by other suitable means. For example, the spout may be clamped to the top wall of the spout by a metal lip extending around the periphery of the aperture.

Figure 10:
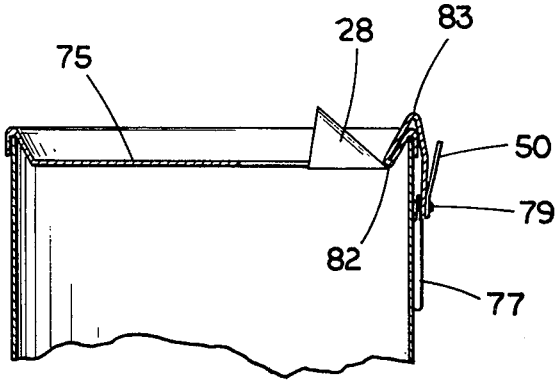
FIG. 10 is the same view as FIG. 2 only showing another embodiment of a container incorporating the present invention with the spout shown in erected position.
Figure 11:
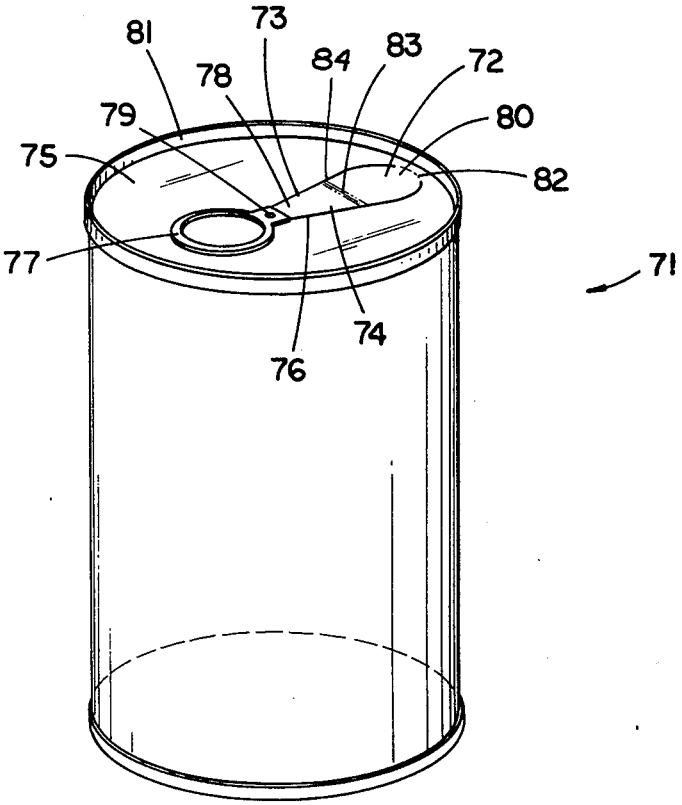
FIG. 11 is a perspective view of the container of FIG. 10.

Another embodiment of the container is shown in FIGS. 10 and 11. Container 71 is identical with the container shown in FIG. 1 except that the tear tab 25 is not removable from the top wall of the container. Container 71 includes a tear tab 72 having opposite edge portions 73 and 74 integrally joined to the top wall 75 of the container along the pair of score lines 84 and 76.

A conventional ring tab 77 is attached to end 78 of tear tab 72 by rivet 79. The score lines 84 and 76 meet at the first end 78 adjacent the ring tab 77. The end 80 of tear tab 72 opposite end 78 is positioned adjacent the rim 81 of the container. Score lines 84 and 76 terminate adjacent second end 80 with end 80 being integrally connected with the top wall 75 of the container and being bendable along crease line 82 which extends between score lines 84 and 76 at end 80. Another crease line 83 extends between the score lines 84 and 76 intermediate ends 78 and 80 with crease line 83 being positioned to engage rim 81 as the tear tab is bent over and against the rim as shown in FIG. 10.

The sanitary drinking spout 28 previously described is provided on container 71 and is identical with the sanitary drinking spout described for the prior embodiments. Likewise, finger 50 shown in FIG. 3 and previously described, is mounted to the bottom of tear tab 72 by fastener 79 and is engaged with the spout providing for automatic erection of the spout.

The method of using container 71 includes the first step of pulling ring tab 77 thereby tearing tab 72 along score lines 84 and 76 to a position immediately adjacent second end 80. As the tear tab is pivoted at end 80, finger 50 pulls out and erects spout 28. The tear tab is then bent at end 80 along crease line 82. Further bending of the tear tab at end 80 results in the positioning of crease line 83 adjacent and atop rim 81. The tear tab is then bent downwardly along crease line 83 until the tear tab and ring tab are adjacent and against the vertical side wall of the container as shown in FIG. 10.

Figure 12:
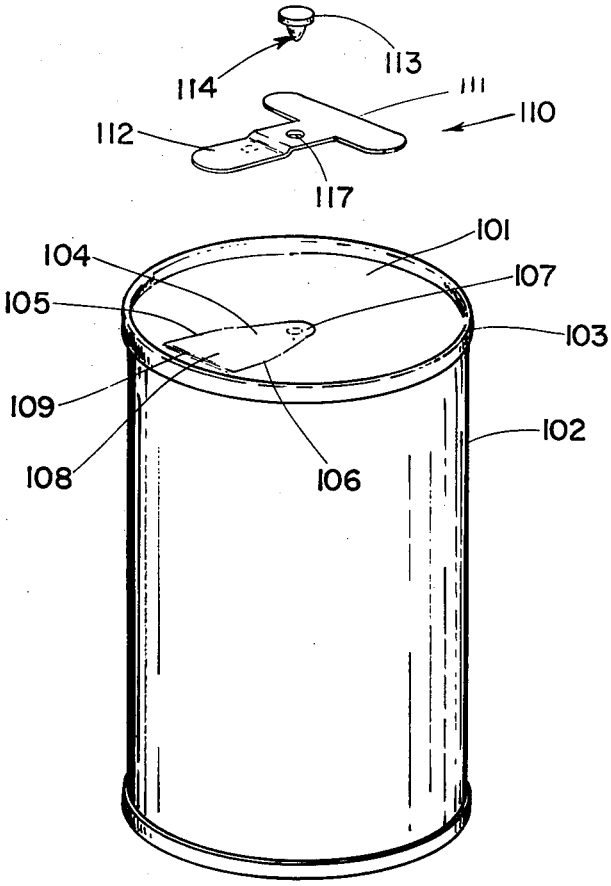
FIG. 12 is a perspective exploded view of the preferred embodiment of a container incorporating the present invention.

The preferred embodiment of the container incorporating the present invention is shown in the exploded view of FIG. 12. The can or container 100 is identical to the prior container 71 described with the exception that a different type of pull is provided and with the exception that different means are used to attach the pull to the container including piercing means for initially puncturing the top wall of the container. Container 100 has a top wall 101 joined to circular side wall 102 along rim 103. Container 100 includes a rear tab 104 having opposite edges integrally joined to the top wall 101 along the pair of score lines 105 and 106. The score lines 105 and 106 meet at the first end 107 of the tear tab positioned approximately in the center of the top wall 101. The end 108 of tear tab 104 opposite end 107 is positioned adjacent rim 103 with score lines 105 and 106 terminating at end 108. A crease or bend line 109 extends along the width of end 108 between score lines 105 and 106.

Figure 13:
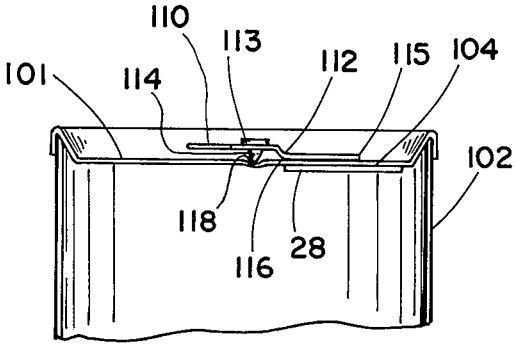
FIG. 13 is a cross-sectional fragmentary view of the container of FIG. 12.

A T-shaped pull 110 is mounted atop tear tab 104 and has a handle portion 111 integrally joined to a main body portion 112. Handle portion 111 extends generally perpendicular to portion 112 which extends in the direction of the length of tear tab 104. A pierce button 113 is attached to and extends through a main body 112 of pull 110 and includes a bottom pointed end 114 which is positioned between pull 110 and the top wall 101 as shown in FIG. 13. The main body 112 of pull 110 is fixedly attached to tear tab 104 from end 115 of the pull to a point 116 of the pull approximately midway between opposite ends of the pull. The pull may be attached to the top surface of tear tab 104 by welding, adhesive means, or other suitable fastening means. The remaining portion of the pull is slightly elevated above the top wall 101. A hole 117 (FIG. 12) is provided in the pull through which the shank of the piercing button 113 extends thereby positioning the bottom pointed end 114 immediately above wall 101. A slight indentation 118 may be provided on top wall 101 immediately beneath pointed end 114 with the indentation slightly weakening the top wall to facilitate puncture of the top wall by pointed end 114 as the piercing button is forced downwardly toward top wall 101. The head of the piercing button is positioned atop the pull 110. The shank of the piercing button may either be conical or plate-like as long as the bottom end of the piercing means 113 is pointed. A spout identical to spout 28 is mounted beneath the tear tab and is automatically erected as the tear tab is opened and pivoted about the rim. A finger 50, as previously described, may be attached to the tear tab and positioned beneath the spout so as to automatically erect the spout. Likewise, various means may be used to automatically erect the spout. For example, the spout may be glued to the undersurface of the tear tab so as to automatically erect as the tear tab is pivoted about the rim.

Figure 14:
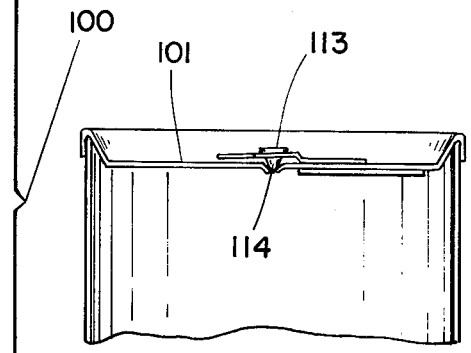
FIG. 14 is the same view as FIG. 13 only showing the initial piercing of the top wall of the container.
Figure 15:
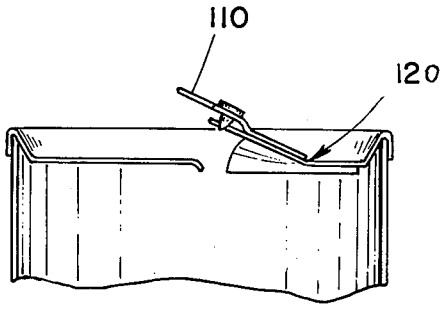
FIG. 15 is the same view as FIG. 13 only showing the container in a partially-open condition.
Figure 16:
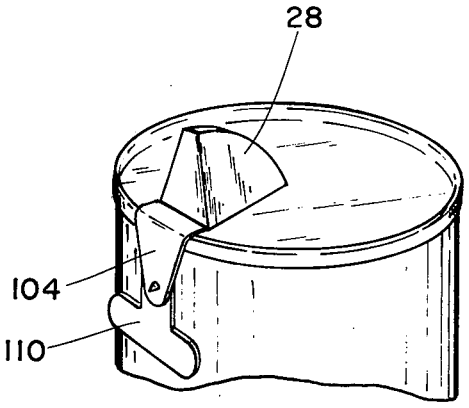
FIG. 16 is a perpective view of the container of FIG. 12 in the open condition with the spout erected.

FIG. 14 shows the bottom distal end 114 of the piercing means 113 piercing the top wall of the container with the pull and tear tab then being pivoted about the end of the pull as shown in FIG. 15 partially opening the container. Continual pivoting of the pull and tear tab results in the container being completely open and the spout erected as shown in FIG. 16. The adhesive means between the undersurface of the tear tab and the spout may be sufficiently weak so as to disengage the spout upon complete erection and when sufficient force is applied between the tear tab and spout. Upon initial piercing of the top wall by pointed end 114 of the piercing means, a portion of the tear tab will lock onto the pointed end so that as the pull is pivoted about one end, the tear tab will follow. Various means may be provided to insure the locking on of the tear tab to the pointed end. For example, the pointed distal end of the piercing means may be provided with a rough or friction surface on the side adjacent the tear tab so as to engage the tear tab as the tear tab and pull are pivoted to the open position.

Many variations are contemplated and included in the present invention. For example, pull 110 shown in FIG. 13 includes a first portion immediately adjacent the tear tab with the remaining portion of the pull being slightly elevated. Alternatively, the pull may be completely flat and not elevated above the top wall with a sufficient indentation provided on the top wall to receive the pointed distal end of the piercing button prior to opening. Of course, sufficient clearance would have to be provided between the pull and the top wall so as to enable the forcing down of the piercing button to pierce the top wall of the container.

The piercing means allows piercing of the top wall so as to initiate tearing along the score lines of the tear tab. That is, when the piercing button 113 is forced downward, the pointed end provides an aperture at indentation 118 and causes the score lines 105 and 106 to break at end 107, separating end 107 of tab 104 from wall 101. The end of the pull tab positioned between the piercing means and the rim contacts the tear tab at a location 120 (FIG. 15) with the tear tab bending about location 120 prior to bending at end 108 of the tear tab during opening of the can.

While the invention has been illustrated and described in detail in the drawings and foregoing description, the same is to be considered as illustrative and not restrictive in character, it being understood that only the preferred embodiments have been shown and described and that all changes and modifications that come within the spirit of the invention are desired to be protected.

The invention claimed is:

1. A container comprising:

a main body including a rim and a top wall with an aperture in said top wall sealingly closed by a tear tab, said tear tab having a pair of opposite edges joined to said top wall along a pair of score lines, said tear tab further having a first end with a pull tab attached thereto and with said score lines meeting at said first end adjacent said pull tab, said tear tab having a second end opposite said first end with said second end positioned adjacent said rim, said pull tab having a handle portion and an elongated main body portion with at least a portion of said main body portion fixedly attached to said tear tab along its length; and means, including a pierce button having a pointed end and extending through and beneath the unattached portion of said pull tab to a point on said tear tab adjacent said first end thereof, for piercing said top wall and for initiating tearing along said score lines adjacent said first end when said pierce button is depressed.

2. The container of claim 1 wherein:

said score lines terminate at said second end with said tear tab being bendable at said second end along a crease line extending the width of said second end and between said score lines to allow said tear tab to be torn along said score lines and bent at said second end over said rim; and the main body portion of said pull tab includes an end between said first end and said second end of said tear tab which contacts said tear tab at a certain location with said tear tab bending about said certain location prior to bending at said second end of said tear tab during outward pivoting of said pull tab and opening of said can.

3. The container of claim 1 in which said pull tab is T-shaped in configuration with the handle portion thereof being elongated and generally perpendicular to the main body portion, said pierce button extending through and attached to the unattached portion of the main body portion of said pull tab.

4. The container of claim 3 additionally comprising a slight indentation in said tear tab adjacent said first end thereof and immediately beneath the pointed end of said pierce button to facilitate puncture and removal of said tear tab when said pierce button is depressed and said pull tab is outwardly pivoted.

5. The container of claim 4 in which the handle portion and unattached main body portion of said pull tab are slightly elevated above said top wall and said tear tab to facilitate depressing of said pierce button and outward pivoting of said pull tab.

6. The container of claim 5 wherein:

said score lines terminate at said second end with said tear tab being bendable at said second end along a crease line extending the width of said second end and between said score lines to allow said tear tab to be torn along said score lines and bent at said second end over said rim; and the main body portion of said pull tab includes an end between said first end and said second end of said tear tab which contacts said tear tab at a certain location with said tear tab bending about said certain location prior to bending at said second end of said tear tab during outward pivoting of said pull tab and opening of said can.

7. The container of claim 6 additionally comprising means for locking said tear tab onto the pointed end of said pierce button when said pierce button is depressed through said indentation in said tear tab prior to outward pivoting of said pull tab and opening of said can.

* * * * *